United States Patent [19]

Evans et al.

[11] Patent Number: 4,549,978

[45] Date of Patent: Oct. 29, 1985

[54] PROCESS FOR MANUFACTURE OF DETERGENT POWDER

[75] Inventors: Elfed H. Evans, Clwys, Wales; Klaus Hirte, Buxtehude; Gerd Stremmel, Brühl, both of Fed. Rep. of Germany

[73] Assignee: Lever Brothers Company, New York, N.Y.

[21] Appl. No.: 664,661

[22] Filed: Oct. 25, 1984

[30] Foreign Application Priority Data

Oct. 26, 1983 [GB] United Kingdom ..... 8328646
Nov. 11, 1983 [GB] United Kingdom ..... 8330199

[51] Int. Cl.[4] ..... C11D 11/02

[52] U.S. Cl. ..... 252/109; 252/110; 252/117; 252/132; 159/0.5; 159/0.6; 159/0.8; 159/48.1; 159/DIG. 10; 159/DIG. 14; 202/90; 202/236; 159/4.04; 159/4.05; 159/4.07

[58] Field of Search ..... 252/109, 110, 117, 132; 159/4 CC, 4 D, 4 F, 48.1, DIG. 10, DIG. 14; 202/236, 90

[56] References Cited

U.S. PATENT DOCUMENTS 3,629,951 12/1971 Davis et al. ..... 159/4 CC
3,629,955 12/1971 Davis et al. ..... 159/DIG. 14
4,261,793 4/1981 Nakamura et al. ..... 252/536
4,274,974 6/1981 Kerkhoven ..... 252/90

FOREIGN PATENT DOCUMENTS 1052847 12/1966 United Kingdom .
1286054 8/1972 United Kingdom .
1514276 6/1978 United Kingdom .

*Primary Examiner*—Paul Lieberman
*Assistant Examiner*—Hoa Van Le
*Attorney, Agent, or Firm*—Milton L. Honig; James J. Farrell

[57] ABSTRACT

A process for manufacturing detergent powder containing heat-sensitive components is disclosed. The process involves preparation of two separate crutcher slurries, one containing the relatively heat-stable components which is sprayed in a conventional manner and a second containing heat-sensitive components which is sprayed into the spray-drying tower at a level lower than the level at which the drying air is injected. Desirably the second slurry is sprayed in a direction which includes an upward component, so as to lengthen the pathway of the sprayed droplets.

8 Claims, No Drawings

PROCESS FOR MANUFACTURE OF DETERGENT POWDER

This invention relates to a process for the manufacture of a detergent powder, and to the powder produced.

Detergent powder is normally made by spray-drying, specifically by spray-drying an aqueous crutcher slurry of components in a counter-current spray-drying tower. The environment in a counter-current spray-drying tower is harsh, since in order to ensure that evaporation takes place in the upper reaches of the tower it is necessary to inject the drying gas, normally air, at a relatively high temperature, 300°–450° C. for instance. This high temperature makes it difficult to produce detergent powders containing heat-sensitive components by spray-drying. On the other hand if the conditions are made milder, for instance by employing a co-current technique or by dropping the air inlet temperature, throughput falls dramatically.

Many of the detergent powders which we produce contain heat sensitive components. For example, many powders contain soap, some in quite substantial amounts, and many also contain nonionic surfactants. Additionally, it has been proposed to incorporate amines, and especially mixtures of amines with soaps into detergent powder. Soaps, amines and nonionic surfactants are examples of substances which are heat sensitive.

This invention relates to a process for manufacture of a detergent powder containing a heat-sensitive component.

According to the present invention there is provided a process for the manufacture of a detergent powder containing a heat-sensitive component which comprises:

(a) forming a first aqueous crutcher slurry and spraying it from a first upper level downwardly into a spray-drying tower;

(b) passing drying gas into the spray-drying tower from a second lower level;

(c) forming a second aqueous slurry and spraying it into the spray-drying tower at a third level, lower than the second level, characterised in that the heat sensitive component is incorporated in the second slurry.

In essence the process of the invention is a combined spray-drying and spray-cooling process using a single, counter-current spray-drying tower.

According to a narrower aspect of the invention there is provided a process for the manufacture of a detergent powder containing an anionic detergent active substance or a nonionic surfactant, and a soap, an amine or a mixture thereof, together with a detergency builder, which process comprises:

(a) forming a first aqueous crutcher slurry comprising at least a part of the anionic detergent active substance or the nonionic surfactant and the builder and spraying it from a first upper level downwardly into a spray-drying tower;

(b) passing hot drying gas upwardly into the spray-drying tower from a second lower level;

(c) forming a second aqueous slurry comprising soap, or an amine or a mixture thereof and spraying it into the spray-drying tower at a third level, lower than the second level.

The incorporation of amines into detergent powders is known. For example, British patent specification No. 1,052,847 describes the use in the wash cycle of solid fabric softeners which are complexes of urea and primary, secondary or tertiary amines. British patent specification No. 1,286,054 discloses a foam-regulating composition containing a fatty acid, a nitrogen-containing compound such as a primary, secondary or tertiary amine and an ethoxylated linear alcohol. British patent specification No. 1,514,276 also describes the use of an amine in a fabric softening composition. The composition can include the amine together with water, or with a diluent in the form of a non surface-active salt. In the latter case the amine, the salt and optionally an anionic detergent are slurried and spray-dried to a powdered composition.

These patent specifications disclose the addition of amine to detergent powder in a post-spraying step rather than during the main spraying process.

For the spray-cooling part of the process to be effective it is desirable for the second slurry to be at a temperature of about 120°–160° C., preferably 140°–150° C., when it is sprayed into the spray-drying tower. Clearly, this means that this slurry will have to be pressurised, typically from 4 bar upwards, preferably 8 to 12 bar. We have found it best to achieve the required temperature by pumping the slurry through a heat exchanger. At a slurry temperature of 140°–150° C. the slurry atomises readily due to the flashing of steam from the slurry so that a spray-dried powder of acceptable granulometry is obtained. However, it is possible to achieve satisfactory atomisation of the slurry at lower temperatures if a gas is introduced into the slurry and mixed in before the slurry is sprayed. It has been found that the compressed gas then has a similar disruptive effect on the sprayed slurry as flashing steam.

The drying gas is normally passed into the spray-drying tower radially and, being hot initially it rises upwardly through the tower. Strictly speaking therefore there should be no air flow in the portion of the tower where it is proposed the second slurry should be sprayed, but in practice there is sufficient turbulence and entrainment of gas by falling powder for drying to take place even at this relatively low level and temperature. Equally, it is possible to introduce the gas at an angle to the radius so as to impart a swirling motion to it. The hot gas moves upwardly in the tower and its flow is assisted by extractor fans. The second slurry is sprayed below the hot gas inlets normally into that lowest portion of the tower which is generally in the form of a cone. If desired, the second slurry can be sprayed into the tower with an upward component of motion to increase the pathway of the droplets/particles within the tower.

The first slurry can contain either an anionic detergent active compound or a nonionic surfactant or a mixture of the two, although the process is especially useful for manufacture of powders containing nonionic surfactants, because it is possible to put higher molecular weight surfactants into the first slurry, leaving lower molecular weight materials which may be required to be incorporated from the detergency point of view via the second slurry. We consider any ethoxylated alcohol nonionic surfactant having either a carbon chain containing fewer than 12 carbon atoms or an ethoxy chain containing fewer than about 20 carbon atoms to be low molecular weight and hence more suitable for incorporation into the powder via the second slurry. Generally the process permits incorporation of nonionic surfactants having from 5–20 carbon atoms in the hydrophobic chain and from 6–40 carbon atoms in the hydrophilic chain. These nonionic surfactants will be present in amounts sufficient to provide levels of from 2 to 25% by weight, preferably 3–20% by weight in the finished powder.

As an alternative, low molecular weight nonionic surfactants can be incorporated into the powder by spraying the liquid or liquefied material onto spray-dried/spray-cooled powder, or onto a combination of such powder with an oxygen bleach such as sodium perborate mono- or tetrahydrate.

As indicated above the process is also useful for manufacturing powder which contains anionic detergent active substances, either alone or in combination with nonionic surfactants. The anionic detergent active substances can be salts of alkyl benzene sulphonates, alkyl sulphates, both primary and secondary or olefine sulphonates, the hydrophobic chains containing from about 10 to about 25 carbon atoms. They will be incorporated into the slurries in amounts sufficient to provide from about 5 to 35% by weight of the powder when present alone, to from 1 to 15% by weight when present in combination with one or more nonionic surfactants. Since non-soap anionic surfactants are not normally heat sensitive they will be incorporated in the first slurry.

Preferably the amine is incorporated into the powder together with soap, in order to produce a powder from the second slurry having an acceptable granulometry.

When the heat-sensitive component is soap, it will generally be incorporated into the detergent powder in an amount of from 1½ to 30% by weight. Although any of the commonly used soaps, such as the sodium soap of coconut fatty acid, tallow fatty acid or mixtures thereof may be incorporated into powders using the process of the invention it is particularly applicable to the especially heat-sensitive soaps. Examples of these are soaps containing unsaturated ethylenic bonds such as soaps of oleic acid-containing oils, eg sunflower oil. Other examples are soaps containing substantial amounts of short chain ($C_{14}$ or less) fatty acids. Lower grade materials, that is to say materials of lower purity which are often very susceptible to oxidation, are particularly suited to the process.

As will now be appreciated, the heat-sensitive component to be incorporated into the powders may be an amine. While the process is applicable to any solid or liquid amine, whether primary, secondary or tertiary, it is especially applicable to tertiary amines capable of imparting wash-softness benefits, since these materials are especially suitable for incorporation into the second aqueous slurry together with soap. The amines are preferably those of the general formula $RR'R^2N$ where R is an alkyl group having from 1 to 6 carbon atoms and R' and $R^2$ are primary linear alkyl or alkenyl groups having from 10 to 26 carbon atoms. Preferably R has from 1 to 4 carbon atoms and is most preferably a methyl group, and R' and $R^2$ preferably each have from 12 to 22 carbon atoms, especially 16 to 18 carbon atoms. R' and $R^2$ are normally linear groups, but a small amount of branching insufficient to alter the character of the compounds as softeners can be tolerated.

When an amine is present together with soap, relative proportions of the amine and the soap are from 2 to 25, preferably from 3 to 20.

The second slurry is also useful for the incorporation of fluorescers. There is always a potential discolouration problem whenever fluorescers are incorporated into detergent powders having relatively low total active detergent content as used in low-sudsing formulations. This discolouration problem is caused by a portion of the fluorescer dissolving in the active system during processing and then coming out of solution subsequently as a yellowish/green crystalline form. One way of circumventing the problem is to increase the nonionic surfactant content of the active system, but increasing the amounts of nonionic surfactant relative to the anionic active could adversely affect the detergency performance under certain wash conditions.

By incorporating the bulk of the fluorescer in the second slurry containing soap it has been found that the potential problem can be avoided without the need to increase the nonionic surfactant content of the final powder.

The first slurry will also contain conventional components of detergent powders in conventional amounts. Thus it will contain a detergency builder and also a number of optional components such as anti-redeposition agents, sodium silicate as a powder structurant and anti-corrosion agent, pH controllers such as soda ash, sodium carbonate and citric acid, fillers such as sodium sulphate and a host of minor components such as anti-oxidants, fluorescers, clays, scum-dispersants, stabilizers such as ethylene diamine tetraacetic acid and organic phosphonate, inorganic salts such as sodium chloride, starches, germicides and colourants.

The second slurry may contain soap and other heat-sensitive component(s) together with sodium silicate, some sodium sulphate and/or soda ash.

In addition, after spray-drying has taken place, other materials may be dosed into the powder. Oxygen and chlorine bleaches such as sodium perborate mono- and tetra-hydrates, sodium percarbonate and sodium trichlorocyanurate, enzymes, perfumes and bleach-activators such as tetra-acetyl ethylene diamine (TAED) and its salts will normally be added in this way.

The invention will be further described in the following examples.

EXAMPLE 1

Two aqueous crutcher slurries having the following composition were prepared:

| | Parts by Weight |
|---|---|
| First Slurry | |
| Nonionic surfactant ($C_{12}$ $EO_{12}$) | 3.9 |
| Sodium soap (68% solution) | 7.6 |
| Sodium tripolyphosphate | 26.0 |
| Sodium silicate (neutral, 35% solution) | 11.2 |
| Sodium hydroxide (50% solution) | 1.7 |
| Sodium carboxymethylcellulose | 1.8 |
| Sodium sulphate | 27.6 |
| Water and minor components | 30.0 |
| Second Slurry | |
| Sodium soap (68% solution) | 15.2 |
| Sodium silicate (neutral, 35% solution) | 11.2 |
| Sodium hydroxide (50% solution) | 1.7 |
| Nonionic surfactant ($C_{12}EO_7$) | 1.3 |

The first slurry was spray-dried conventionally in a counter-current spray drying tower, using a slurry temperature of 80° C. and a hot air inlet temperature of 400° C.

The second slurry was sprayed into the conical portion of the spray-drying tower at a level below the hot air inlet at a temperature of 150° C. A single spray-dried powder emerged from the base of the tower and was fed to a conveyor belt where it was sprayed with liquid $C_{12}EO_7$ nonionic surfactant in a ratio of 29.4 parts by weight of spray-dried powder to 2.6 parts of nonionic surfactant.

76.7 parts of the powder were then admixed in a fluidised bed mixer with 22 parts by weight of sodium perborate tetrahydrate, 1 part by weight of coloured sodium tripolyphosphate speckles, 0.2 parts by weight of an enzyme and 0.1 part by weight of a perfume.

The resultant powder had the following formulation:

| | % by Weight |
|---|---|
| Nonionic surfactant ($C_{12}EO_{12}$) | 3.0 |
| Nonionic surfactant ($C_{12}EO_7$) | 3.0 |
| Sodium soap | 12.0 |
| Sodium tripolyphosphate | 21.0 |
| Sodium silicate | 6.0 |
| Sodium carboxymethyl cellulose | 1.0 |
| Sodium sulphate | 21.2 |
| Sodium perborate | 22.0 |
| Enzymes | 0.2 |
| Perfume | 0.1 |
| Water and minor components to | 100.0 |

EXAMPLE 2

Two aqueous crutcher slurries having the following formulation were prepared:

| | % by weight |
|---|---|
| First slurry composition | |
| Sodium alkyl benzene sulphonate paste (34%) | 18.7 |
| Ethoxylated alcohol surfactant 7EO | 4.6 |
| Sodium tripolyphosphate | 30.5 |
| Sodium sulphate | 0.5 |
| Sodium silicate (47.8%) | 14.0 |
| Water and minor components balance to | 100.0 |
| Second slurry composition | |
| Fatty acid (mean molecular weight 264) | 43.4 |
| Sodium hydroxide solution (46.5%) | 13.0 |
| Sodium silicate (47.8%) | 0.2 |
| Fluorescer slurry (32%) | 2.5 |
| Methyl di-hardened tallow amine | 16.8 |
| Water and minor components balance to | 100.0 |

These two slurries were sprayed concurrently into a spray-drying tower in a ratio of 3.9 parts of the first to 1 part of the second. The first slurry was sprayed from a level above the hot-gas entry and the second from a level below. The spray-dried detergent powder produced had an average moisture content of 14.5% by weight. After cooling in an air-lift the powder was admixed with other components in a fluidised bed mixer in the proportion 74.45 parts by weight of spray-dried powder, 25 parts of sodium perborate, 0.4 parts of an enzyme and 0.15 parts of a perfume.

The resultant powder had the following composition:

| | % by weight |
|---|---|
| Sodium alkyl benzene sulphonate | 5.9 |
| Ethoxylated alcohol 7EO | 4.2 |
| Sodium soap | 11.0 |
| Sodium tripolyphosphate | 28.0 |
| Sodium sulphate | 0.5 |
| Sodium silicate (alkaline) | 7.8 |
| Sodium carboxymethyl cellulose | 0.8 |
| Fluorescer | 0.3 |
| Methyl di-hardened tallow amine | 4.0 |
| Sodium perborate | 25.0 |
| Enzyme | 0.4 |
| Perfume | 0.15 |
| Water and minor components balance to | 100.0 |

The advantages of the process of the invention are first, that relatively heat sensitive components can be spray-dried without the necessity for reducing tower temperatures and hence through-puts. Secondly, that significant amounts of a heat-sensitive component can be incorporated into a powder formulation, but the characteristics typical of a synthetic detergent powder on addition to water (quick wetting and lack of gelling) can be approached.

We claim:

1. A process for the manufacture of a detergent powder containing a heat-sensitive component which comprises:

(a) forming a first aqueous crutcher slurry and spraying it from a first upper level downwardly into a spray-drying tower;

(b) passing drying gas into the spray-drying tower from a second lower level;

(c) forming a second aqueous slurry and spraying it into the spray-drying tower at a third level, lower than the second slurry;

characterised in that the heat-sensitive component is incorporated in the second slurry.

2. A process according to claim 1 wherein the second aqueous slurry comprises soap.

3. A process according to claim 1 wherein the second aqueous slurry comprises an ethoxylated alcohol nonionic surfactant.

4. A process according to claim 1 wherein the second aqueous slurry comprises a soap and an amine.

5. A process according to claim 1 wherein the second slurry is heated to a temperature of from 120°–160° C. immediately prior to spraying into the spray-drying tower.

6. A process according to claim 1 wherein the second slurry is sprayed into the spray-drying tower with an upward component of motion.

7. A process according to claim 1 wherein the first slurry comprises an anionic surfactant, optionally in combination with an ethoxylated alcohol nonionic surfactant having either a carbon chain containing more than 12 carbon atoms, or an ethoxy chain containing 20 or more carbon atoms.

8. A process according to claim 1 wherein the second slurry comprises sodium silicate or soda ash.

* * * * *

UNITED STATES PATENT AND TRADEMARK OFFICE

CERTIFICATE OF CORRECTION

PATENT NO. : 4,549,978

DATED : October 29, 1985

INVENTOR(S) : Evans et al.

It is certified that error appears in the above—identified patent and that said Letters Patent is hereby corrected as shown below:

In claim 1, column 6, line 38, replace "slurry" with -- level --.

Signed and Sealed this

Twenty-ninth Day of December, 1987

*Attest:*

DONALD J. QUIGG

*Attesting Officer*

*Commissioner of Patents and Trademarks*